US006102313A

United States Patent [19]

Salzsauler et al.

[11] Patent Number: 6,102,313

[45] Date of Patent: Aug. 15, 2000

[54] METHOD AND APPARATUS FOR PRODUCING CORELESS ROLLS OF SHEET MATERIAL AND A CORELESS ROLL OF MATERIAL

[75] Inventors: Donald J. Salzsauler, Georgetown, Canada; Edward R. Salzsauler, Barbados, Wis.; Richard G. Salzsauler, Rockwood, Canada

[73] Assignee: Saltech Inc., Barbados

[21] Appl. No.: 09/021,505

[22] Filed: Feb. 10, 1998

[30] Foreign Application Priority Data

Jul. 30, 1997 [CA] Canada ..... 2212025
Jan. 23, 1998 [CA] Canada ..... 2228020

[51] Int. Cl.[7] ..... B65H 18/28

[52] U.S. Cl. ..... 242/160.4; 242/410; 242/534.2; 242/541.4; 242/571.1

[58] Field of Search ..... 242/160.4, 534.2, 242/534, 535, 541.4, 541.5, 541.6, 541.7, 571.1, 571.2, 410, 160.1

[56] References Cited

U.S. PATENT DOCUMENTS

| | | |
|---|---|---|
| 947,344 | 1/1910 | Nicholson . |
| 1,831,201 | 11/1931 | Sieg . |
| 2,285,229 | 6/1942 | Roberts et al. . |
| 2,331,743 | 10/1943 | Sullivan . |
| 2,711,863 | 6/1955 | Grettve . |
| 3,194,762 | 7/1965 | Browning et al. . |
| 4,166,589 | 9/1979 | Hoover et al. . |
| 4,487,378 | 12/1984 | Kobayashi . |
| 5,040,356 | 8/1991 | Thimon . |
| 5,308,010 | 5/1994 | Hakiel . |
| 5,374,006 | 12/1994 | Mheidle . |
| 5,474,248 | 12/1995 | Bradshaw et al. . |
| 5,531,393 | 7/1996 | Salzauler et al. . |

FOREIGN PATENT DOCUMENTS

| | | |
|---|---|---|
| 0 496 503 A1 | 9/1992 | European Pat. Off. . |
| WO 97/01502 | 1/1997 | WIPO . |

OTHER PUBLICATIONS

Patent Abstracts of Japan, vo. 015, No. 370 (M–1159), Sep. 18, 1991 & JP 03 147661 A (Kasuga Seishi Kogyo KK), Jun. 24, 1991.

Patent Abstracts of Japan, vol. 015, No. 086 (M–572), Mar. 17, 1987 & JP 61 238639 A (Teijin Ltd.), Oct. 23, 1986.

*Primary Examiner*—Donald P. Walsh
*Assistant Examiner*—William A. Rivera
*Attorney, Agent, or Firm*—Fitzpatrick, Cella, Harper & Scinto

[57] ABSTRACT

A roll of sheet material, such as plastic film wrap, having an inner layer wound at low tension and an outer layer wound under greater tension provides a coreless roll. Eliminating the need for a core reduces the cost of producing rolls of sheet material, and reduces the weight and outer dimensions of the roll with a consequent reduction in shipping and storage costs. An apparatus and method for producing such a roll, from a pre-wound master roll or as part of a production line for forming the sheet material, involves varying the longitudinal tension applied to sheet material as it is wound onto an expandable mandrel. After the roll has cured, the mandrel is collapsed and disengaged from the roll to provide a coreless roll. The mater roll can be prestretched prior to forming the coreless roll, if desired, and can be prestretched as a step in the formation of the coreless roll.

14 Claims, 4 Drawing Sheets

METHOD AND APPARATUS FOR PRODUCING CORELESS ROLLS OF SHEET MATERIAL AND A CORELESS ROLL OF MATERIAL

FIELD OF THE INVENTION

The present invention relates to sheet material. In particular, this invention relates to a method and apparatus for producing coreless rolls of sheet material, such as plastic film wrap, and a coreless roll of sheet material.

BACKGROUND OF THE INVENTION

Plastic film wrap is commonly used in a number of commercial applications, particularly the packaging of goods for shipment. For example, plastic film wrap can be employed to bind together single units, or to secure a number of units to pallets or the like. Typically, goods are stacked on a pallet and secured thereto with straps; a continuous winding of a sheet of plastic film; or a combination of straps and plastic film.

It is known that the utility of plastic film for the purpose of securing goods can be enhanced by stretching the film to near its yield point and then permitting the film to relax slightly. Stretching reduces the thickness of the film, and provides a greater length of film for wrapping. The resulting stretched film exhibits an increased tensile strength and a "memory", or tendency to contract toward its unstretched length when stretching tension is removed. For example, a stretched film with a 10% memory will shrink 10% of its stretched length when it relaxes as it is wound about a pallet load. This shrinkage assists in securely holding the palletized goods onto the pallet under compression thereby decreasing the shifting of goods on the pallet during transport.

Stretched film can be wrapped around a pallet load either manually or automatically. Manual devices for stretching plastic film as it is wound about a pallet load, such as described in U.S. Pat. No. 4,166,589, include hand actuated braking mechanisms to stretch the film as it is wound about the pallet load from a roll. Such devices have several disadvantages, including a need for sufficient physical strength on the part of the person wrapping, to stretch the film, and the likelihood of uneven stretching tension being applied to the film as it is wrapped. It is also known to provide a plastic film stretching device as a component of an automated wrapping machine, as is described in U.S. Pat. No. 5,040,356. However, such an arrangement increases the cost, intricacy and size of the automated wrapping device.

Providing rolls of pre-stretched film overcomes many of the disadvantages of the above-described devices. Typically, pre-stretching involves passing a sheet of plastic film through a series of staggered rollers having different diameters and/or different rotational velocities such that the sheet is tensioned lengthwise by a predetermined amount and, consequently, is stretched. Conventionally, after passing through the rollers, the tension on the film is lessened to permit the film to relax slightly, and the stretched film is wound onto a core for later use. Film can be pre-stretched after its initial manufacture, as described in U.S. Pat. No. 5,531,393, or as part of the film manufacturing process wherein molten plastic is formed into a film, cooled, stretched as above, and wound onto a core for later dispensing.

Generally, the core is a hollow plastic or fiberboard tube which helps to maintain the shape of the roll. A hollow core permits the roll to be mounted on a spindle to unwind the film from the roll. There are a number of disadvantages associated with the use of cores in rolls of film wrap. Fiberboard cores, especially those intended for large commercial rolls of plastic film, have to withstand handling and the crushing forces of the film which is rolled upon them under tension. As a result, the cores are generally of heavy, thick fiberboard, with a high glue content for added rigidity. Depending on the size of the roll, the cores can have a weight ranging from approximately 0.5 to 2 kg (1 to 3 lbs.), can have an outer diameter of up to 10 cm (4 in), and can have a thickness of up to 2.5 cm (1 in.). Such cores form a significant portion of the total radial dimension and weight of each roll of film. Thus, the cores increase the cost of shipping rolls of film by decreasing the number of rolls which can be packed and shipped in a container, and increasing the weight of the shipment. Further, the cores used in conventional plastic film rolls are relatively expensive and can account for up to a fifth of the final price of a roll of film. Also, the high glue content in the fiberboard cores makes them unsuitable for recycling, with the consequence that they must be discarded in a landfill site, or in other non-environmentally friendly manners.

Additionally, due to the memory of the film, pre-stretched film has a tendency to shrink and compress around a rigid core by the same percentage it would compress about a pallet load. Over time the multiple layers of film forming the roll tend to fuse together making it difficult to unroll the film for later use. One method of overcoming the tendency of the pre-stretched film to fuse together is described in the above-mentioned U.S. Pat. No. 5,531,393, where a method of producing a roll of pre-stretched plastic film includes a step of embossing the film with a textured roller as it is being stretched. As the embossed film is wound on a core, the embosses trap air between the layers of film, separating the layers and preventing their fusing. However, this solution still requires that the film be wound onto a core.

SUMMARY OF THE INVENTION

It is an object of the present invention to provide a novel coreless roll of sheet material and a novel method and apparatus for forming a coreless roll of sheet material which obviates or mitigates at least one of the disadvantages of the prior art.

According to a first aspect of the present invention, there is provided an apparatus for producing a coreless roll from material supplied as a continuous sheet, comprising:

- a mandrel having a first configuration wherein a length of said sheet can be wound into a roll on a surface of the mandrel with a first perimeter and a second configuration wherein said surface has perimeter less than said first perimeter to allow said mandrel to be removed from said roll;
- a tensioner to tension said supplied length;
- a winder to rotate said mandrel to wind said length of sheet of material onto said surface of said mandrel; and
- a controller to activate said tensioner to tension said sheet of material being wound onto said surface of said mandrel after a preselected amount of sheet of material has been wound thereon.

According to another aspect of the present invention, there is provided a method of producing a coreless roll from material supplied as a continuous sheet, comprising the steps of:

(i) winding, substantially tension free, a first portion of the length of said sheet onto the perimeter of a mandrel;

(ii) winding, under tension greater than that in step (i), a second portion of the length of said sheet material onto said mandrel to form a roll thereon;

(iii) decreasing the perimeter of said mandrel and removing said mandrel from said roll.

According to yet another aspect of the present invention, there is provided a coreless roll formed from a continuous sheet of material, comprising:

a first portion of said continuous sheet of material wound to form an inner layer of said roll, said first portion being wound under substantially no tension;

a second portion of said continuous sheet of material wound to form an outer layer of said roll surrounding said inner layer, said outer layer being wound under a greater tension than said inner layer.

The present invention provides a roll of material which does not require a core for shipping and/or of the material of the roll. When the material is resilient and/or plastic material, the material is first wound under substantially no tension to form an inner layer of the roll and then an outer, and generally longer, portion is wound under a greater tension to complete the roll. Preferably, the roll is wound on a mandrel whose diameter can be reduced to allow easy removal of the mandrel from the completed roll. Also, for some materials such as resilient or plastic materials, the roll is allowed to cure after winding and before removing the mandrel.

BRIEF DESCRIPTION OF THE DRAWINGS

Embodiments of the present invention will now be described, by way of example only, with reference to the attached Figures, wherein.

DETAILED DESCRIPTION

Figure 1:
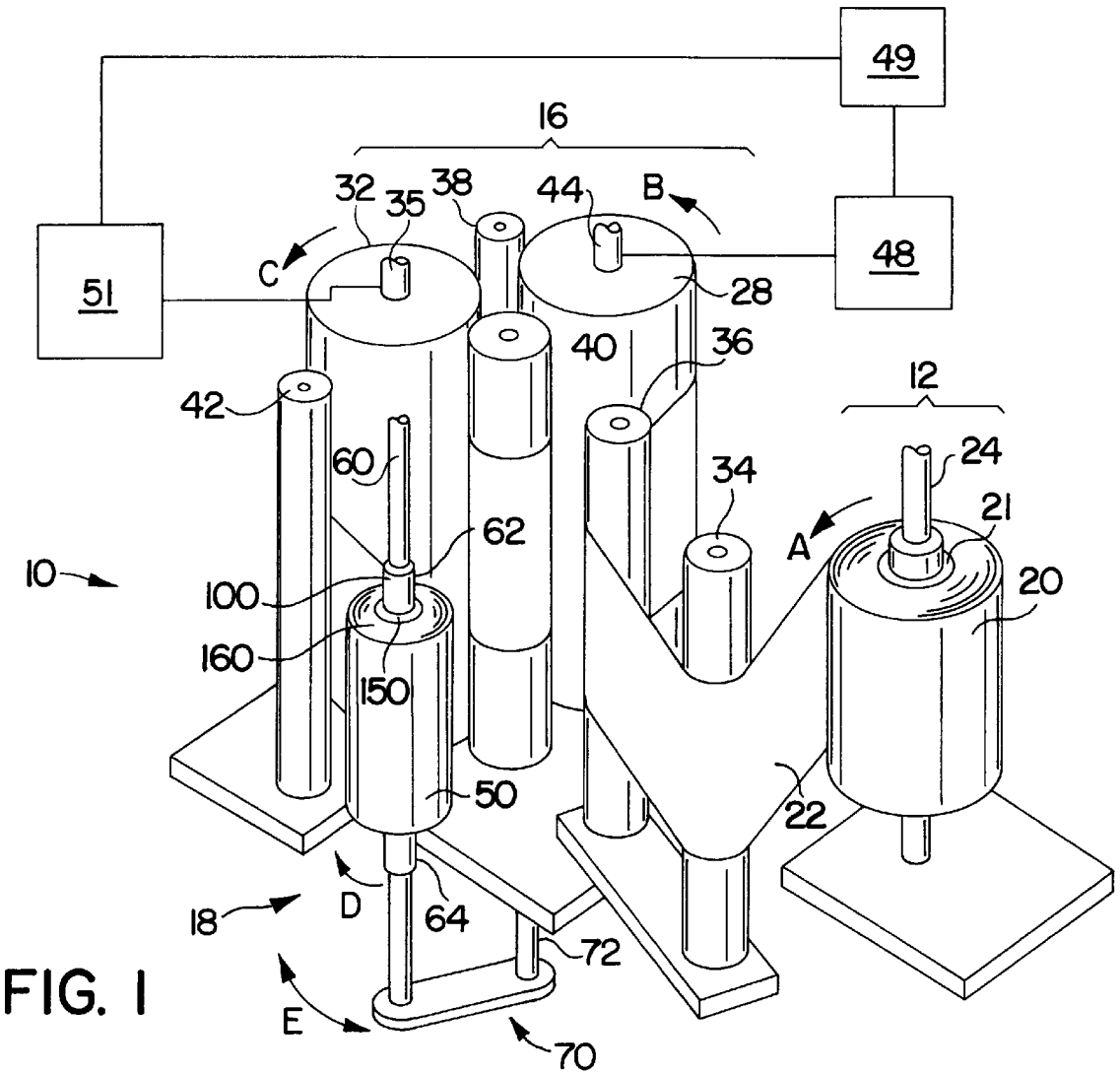
FIG. 1 is a perspective view of an apparatus for producing coreless rolls of sheet material according to the present invention.

FIG. 1 shows an apparatus, generally indicated as 10, for forming a coreless roll of sheet material, according to a first embodiment of the present invention. Apparatus 10 generally consists of a feed means 12, a tensioning means 16 and a take-up means 18. In the following description of a preferred embodiment of the present invention, the sheet material is a plastic film wrap, however, other materials commonly supplied as a continuous sheet wound onto a core, such as aluminum foil and the like, are within the scope and contemplation of the described invention.

Feed means 12 consists of a master roll 20 of plastic film which has been previously wound onto a core 21 of fiberboard, plastic or other suitable material, and a feed spindle 24 for supporting mater roll 20 through its hollow core an around which master roll 20 can freely rotate. The film is in the form of a sheet 22 which can be unrolled from master roll 20. As will be more fully described below, feed means 12 can also be a front end of a production line for producing plastic film from a molten material.

The plastic film composition can be chosen from polyethylene, polyvinyl chloride, ethylene vinyl acetate, ethylene methyl acetate, ethylene copolymer with higher alpha olefins, commonly referred to as linear low density polyethylene, or LLDPE or any other plastic film suitable for wrapping or other like application. The plastic film can be pre-stretched for added strength, or unstretched. However, it has been found that certain films which have not been pre-stretched, as are well known to those of skill in the art, can benefit from aging before being formed into a coreless plastic film roll. As used herein, "aging" the plastic film refers to a process of storing master rolls of plastic film to permit certain residual products of manufacture to dissipate from the film. The master rolls are, typically, aged for up to three weeks, if applicable.

Sheet 22 is unwound from master roll 20 by tensioning means 16. Tensioning means 16 generally consists of a drive roller 28, a lay-on roller 32, and idler rollers 34, 36, 38, 40 and 42. Idler rollers 34, 36, 38, 40, and 42 serve to guide and position sheet 22 as it passes through tensioning means 16. The number, relative size and position of idler rollers 34, 36, 38, 40, and 42 depend upon the desired configuration of apparatus 10, the composition and gauge of sheet 22 and the speed at which it is desired to operate apparatus 10, as is known to those of skill in the art. While idler rollers are employed with a present embodiment of the invention, they can be omitted altogether, if desired. All the rollers in apparatus 10 can be provided with a rubber, or rubber-like, coating to increase the their sheet gripping ability.

Drive roller 28 is fixed to a shaft 44 which is, in turn, mechanically connected to a drive mechanism 48 which rotates shaft 44 in the direction of arrow "B". Drive mechanism 48 can be any conventional drive system, such as a hydraulic system or an electric motor directly attached to shaft 44, or an indirect drive provided by a system of belts, chains or any other suitable mechanism. Actuation and speed control of drive 48 is provided by a control unit 49, typically an electronic or programmable control.

Similarly, lay-on roller 32 is mounted on a shaft 35. A drive mechanism 51 drives shaft 35, and hence, lay-on roller 32, along an axis of rotation in the direction of the arrow marked "C". While drive mechanism 51 can be a separate drive, such as an electric motor, under the control of a control unit 49, it is contemplated by the present inventors that a hydraulic drive can power both drive roller 28 and lay-on roller 32, or that a suitable gearing system, as will be apparent to those skilled in the art, can be employed to transmit power to both shafts 35 and 44. Sensors (not shown) can be included in control unit 49 to detect the rotational velocities of drive roller 28 and lay-on roller 32.

Take-up means 18, onto which a coreless roll 50 of film is wound, consists of a shaft 60 attached to a support 70, and an expandable mandrel 100 mounted on shaft 60. Shaft 60 includes upper 62 and lower 64 collars which receive mandrel 100 such that mandrel 100 rotates with shaft 60. Collars 62 and 64 can be opened, or moved away from each other along shaft 60, in any suitable manner to allow an empty mandrel 100 to be loaded and a wound mandrel 100 to be unloaded from shaft 60. It is also contemplated that, in an alternative, mandrel 100 can instead include means, such as a receptacle (not shown) at each end, to directly engage the ends of shaft 60. In such a case, the ends of shaft 60 will be moved apart to load or unload a mandrel 100.

Shaft 60, and thus any loaded mandrel 100, is permitted to rotate freely at its point of attachment to support 70. Support 70 includes a shaft 72 which permits shaft 60 and support 70 to pivot, as indicated by the arrow "E", such that mandrel 100 can be held in frictional contact with lay-on roller 32. Hydraulic or spring means (not shown) can be employed to apply the desired pressure to hold mandrel 100 against lay-on roller 32.

Figure 2:
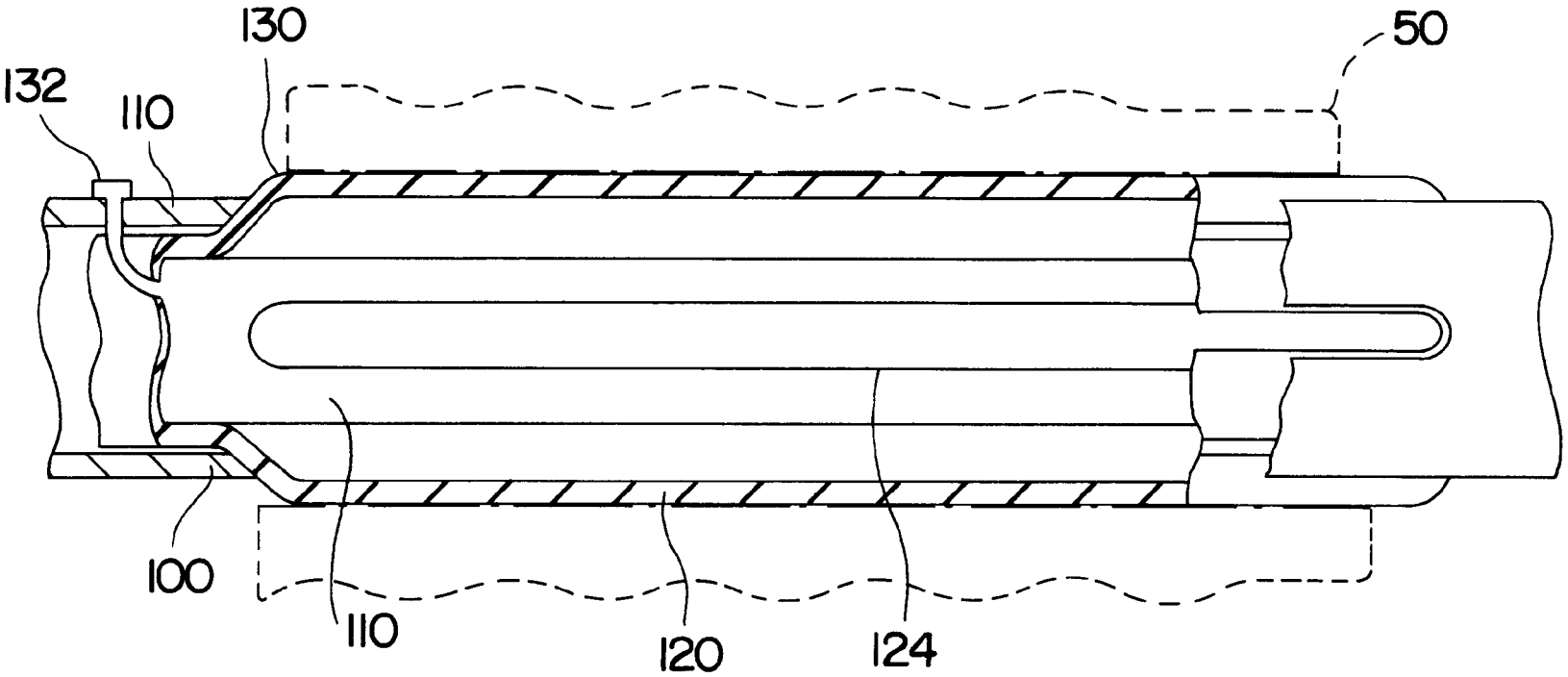
FIG. 2 is an longitudinal cross-section of an expandable mandrel employed with the present invention, in an expanded state.
Figure 4:
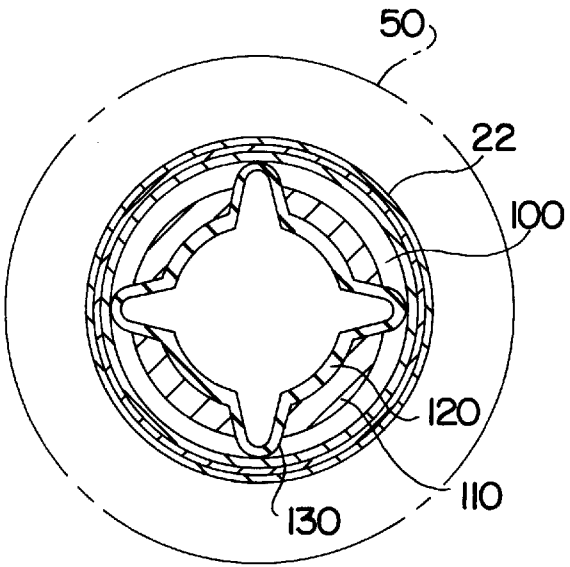
FIG. 4 is a radial cross-section of the mandrel of FIG. 2 in an expanded state.
Figure 3:
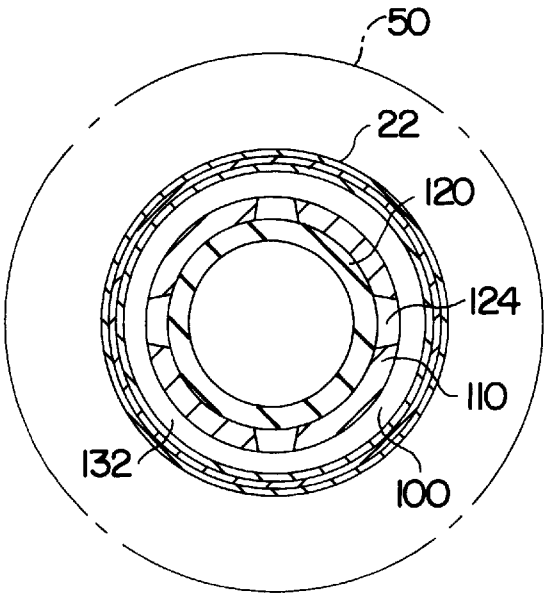
FIG. 3 is a radial cross-section of the mandrel of FIG. 2, in a collapsed state.

FIGS. 2, 3 and 4 show mandrel 100 in greater detail. Mandrel 100 consists of a tube 110 with an internal bladder 120. Tube 110 is made of a rigid material such as steel or plastic, and is at least as long as sheet 22 is wide. A plurality of slots 124, having closed ends, are axially pierced in tube 110. Slots 124 are equally circumferentially spaced and extend nearly the length of tube 110. Tube 110 has a radial dimension which is defined herein as the original radial dimension of mandrel 100. In the illustrated embodiment, tube 110 of mandrel 100 is shown having four equally circumferentially spaced slots 124. However, the desired increase in radial dimension of mandrel 100 can be effected with three or more spaced slots.

Bladder 120 is an inflatable tubular bladder made of a resilient plastic, rubber or rubberized fabric. When mandrel 100 is in a collapsed, or uninflated, state, bladder 120 conforms to the interior wall of tube 110, as best illustrated in FIG. 3. When mandrel 100 is in an expanded, or inflated, state, sections 130 of bladder 120 protrude from slots 124 and effectively increase the radial dimension of mandrel 100, as shown in FIG. 4. A valve 132, connected to bladder 120, permits bladder 120 to be inflated or deflated as desired. A feed from a hydraulic system, or a conventional pressurized air tank, can be used for this purpose. Mandrel 100 acts as a temporary core for roll 50 (shown in dashed outline) during the production of a coreless roll in accordance with the present invention. As will be apparent to those of skill in the art, the present invention is not limited to the use of mandrel 100 and any other mandrel, which is suitable for use as a temporary core, can be employed. For example, it is contemplated that a mandrel with mechanically actuated expansion surfaces can also be employed.

The method for producing a coreless roll of film with apparatus 10 will now be described with reference to FIGS. 1, 3 and 4. Master roll 20 is placed on spindle 24 such that sheet 22 will unwind in the direction indicated by arrow "A". mandrel 100 is inflated and fitted between collars 62 and 64 of shaft 60, and take-up means 18 is urged against lay-on roller 32. A leading end of sheet 22 is fed, either manually or automatically, through apparatus 10, around idler rollers 34, 36, 38, 40 and 42, drive roller 28 and lay-on roller 32, in the manner shown in FIG. 1, until a sufficient length of sheet 22 is available to wrap around inflated mandrel 100, approximately one turn, thus securing sheet 22 to mandrel 100.

Once sheet 22 has been secured to mandrel 100, the hydraulic means urging take-up means 18 against lay-on roller 32 is engaged. In the illustrated embodiment, as lay-on roller 32 rotates in the direction of arrow "C", the contact between lay-on roller 32 and mandrel 100 causes shaft 60 to rotate in the opposite sense to lay-on roller 32, as indicated by arrow "D". Sheet 22 is thus transferred, or "laid on", to mandrel 100 to form roll 50. As will be apparent to those skilled in the art, take-up means 18 pivots away from lay-on roller 32 as roll 50 grows in thickness, but continues to urge roll 50 against lay-on roller 32. When roll 50 reaches a desired thickness, the hydraulic means applying pressure to take-up means 18 is disengaged, sheet 22 is cut, and mandrel 100 containing roll 50 is removed from shaft 60. A new mandrel 100 can then be mounted on shaft 60 and the process repeated until master roll 20 has been exhausted.

For resilient materials, such as plastic film, the ability to control and vary the longitudinal tension in sheet 22 as it is laid on to mandrel 100 can be employed to produce a roll which is more stable (i.e.—the ability of the sheet material to slide laterally off the roll is reduced). In general, it has been found that varying the tension applied to sheet 22 as it is wound onto mandrel 100 can be beneficial to the eventual stability of coreless roll 50. For example, referring to FIGS. 3 and 4, to produce a stable coreless roll 50 from unstretched film which will not tend to slide off of the roll or collapse or deform inwardly, it has been found that an initial winding of sheet 22 should be laid on to mandrel 100 to form layers 150 with substantially no applied tension (i.e.—about zero pounds tension). The total thickness of these substantially tension-free inner layers 150 depends upon the desired total radius of roll 50, but will generally be in the range of from about 2.5 to about 5 cm (about 1 to about 2 inches). The remainder of roll 50, forming outer layers 160, is then wound with a slight applied tension. The amount of tension applied will vary with the sheet material being wound and with the cross-sectional area of that sheet material (i.e.—the product of the width of the sheet and its thickness). Generally, it is contemplated that the tension will not exceed about 20 pounds and will, in many cases be substantially lower. For example, when winding a sixteen inch wide plastic film of approximately 32 gauge (i.e.—a thickness of thirty-two thousandths of an inch), a tension of one pound has been found to produce good results. It is believed that those of skill in the art will be able to determine easily, by empirical or other suitable means, an appropriate tension level for various materials and cross-sectional sizes.

The determination of when to switch from winding layers 150 to winding layers 160 can be made in a variety of manners, including: measuring the thickness of layers 150 formed with a suitable means, including infrared or mechanical sensors; by measuring the length of sheet material 22 which has been wound onto mandrel 100, with any suitable sensor for measuring the length of sheet material 22 which has been unwound from master roll 20; by measuring the elapsed time from which winding of layers 150 commences; by an operator of apparatus 10 observing the winding operation, etc. When the determination is made, whether by automatic means or by the operator, the tension at which sheet material 22 is to be wound can then be altered.

Layers 150 form a structure which prevents collapse of roll 50, once mandrel 100 is removed, as described below. It is presently believed that layers 150 further enhance the ability of air to be trapped between the successive layers 150 or roll 50 and such trapped air can help to provide rigidity to the completed roll 50.

Varying the longitudinal tension applied to sheet 22 using apparatus 10 is accomplished by varying the speeds at which drive roller 28 and lay-on roller 32 are driven, and is controlled by control unit 49. Generally, sheet 22 is tensioned by the pulling action exerted on the sheet 22 by drive roller 28. When lay-on roller 32 is driven at a rotational velocity less than drive roller 28, little or no tension is applied to sheet 22 as it is wound onto mandrel 100 and, when lay-on roller 32 is driven at a faster rotational velocity than drive roller 28, sheet 22 is tensioned as it passes from drive roller 28 to lay-on roller 32 and onto mandrel 100.

After a completed roll 50 has been wound, roll 50 and mandrel 100 are removed from collars 62 and 64 and, preferably, roll 50 is permitted to cure for a pre-determined time. During curing, roll 50 contracts, as sheet material 22 relaxes, and stabilizes around mandrel 100. Outer layers 160 relax to a greater extent than inner layers 150, due to their respective greater winding tension, and a stable roll 50 results. The curing time depends upon the size of roll 50 and the composition of the film, and can be easily determined empirically by those of skill in the art, but is generally in the range of about 5 to about 15 minutes for LLDPE film. Once the roll 50 has cured, mandrel 100 can be deflated and removed from roll 50 thus producing a coreless roll of film.

As will be apparent to those of skill in the art, the above-described configuration of the rollers and the path of sheet 22 therethrough can be modified as desired to suit the needs and production requirements of a user. In particular, the path of sheet 22 through the apparatus 10 and the directions of rotation of drive roller 28, lay-on roller 32 and mandrel 100 are intended as examples only, and can be modified as necessary to integrate with pre-existing machinery or production lines.

Further, if master roll 20 has not been prestretched, prestretching can be performed by apparatus 10 as part of the process of manufacturing roll 50. Specifically, in such a case the diameter of lay-on roller 32 can be larger, relative to drive roller 28, to prestretch sheet material 22 and one or both of drive roller 28 and lay-on roller 32 can include a textured surface (not shown) to emboss the stretched sheet material 22. Suitable methods and techniques for prestretching sheet material are taught in more detail in the above-mentioned U.S. Pat. No. 5,531,393.

As will be apparent to those of skill in the art, master roll 22 can be of a longer length than roll 50 and thus master roll 20 can be employed to make more than one roll 50. Further, when sheet material 22 is pre-stretched in apparatus 10, the final length of sheet material 22 can be increased through apparatus 10 and thus two or more rolls 50 can be manufactured from a single master roll 20, even when matter roll 20 is the same length as either roll 50.

Figure 5:
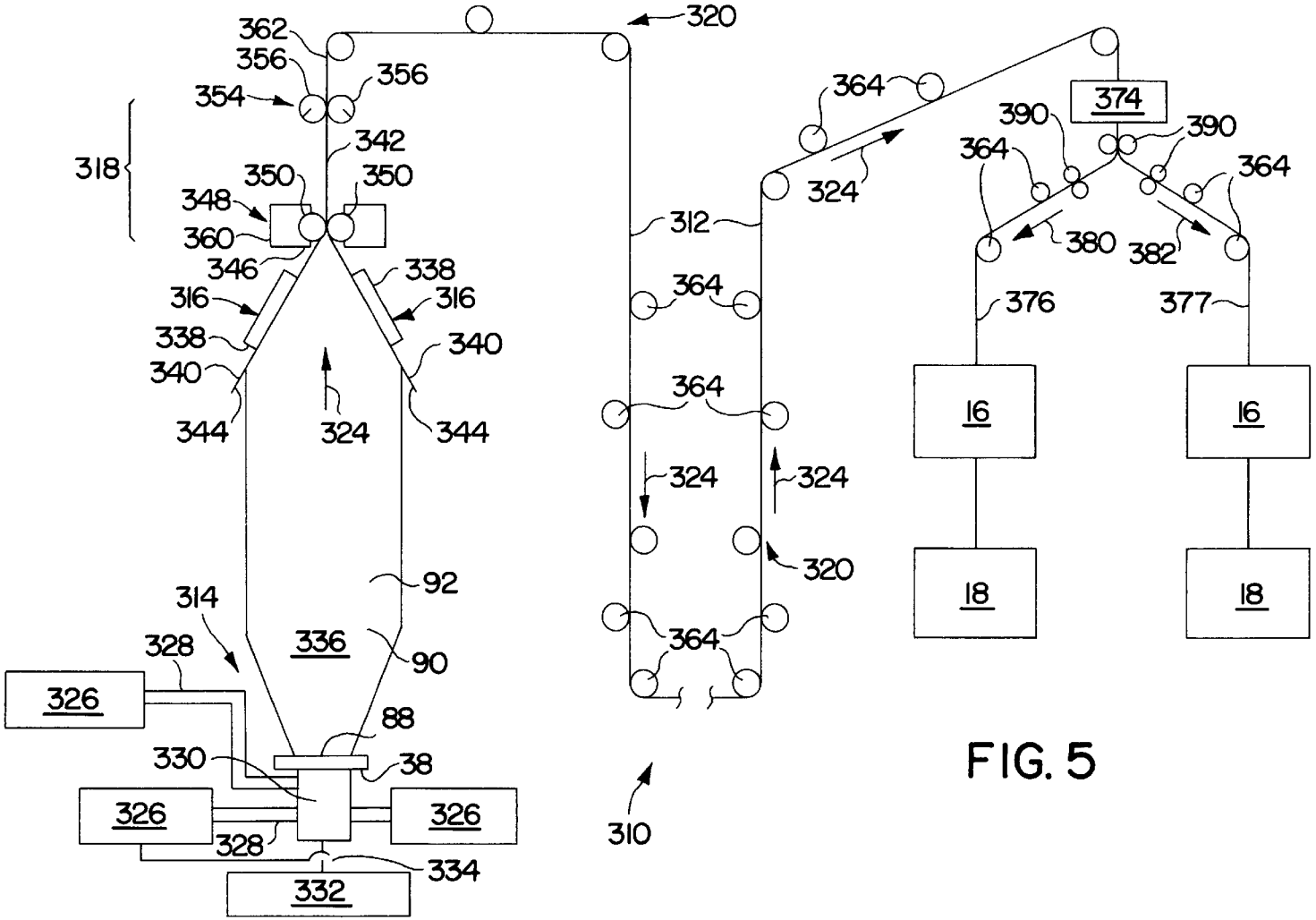
FIG. 5 shows a block diagram of an apparatus for producing coreless rolls of sheet material during the manufacture of the film from a molten material.

A coreless roll of plastic film can also be formed as part of a manufacturing process for plastic film. FIG. 5 shows a block diagram of apparatus 10 integrated with known production line apparatus 310, for the in-line production of coreless rolls of pre-stretched plastic film. Apparatus 310 generally consists of means 314 for known construction for forming a film 312 from molten material, means 316 for cooling the film, 318 for stretching the film beyond its yield point, means 320 for relaxing the stretched film before it is fed to tensioning means 16 and thence to take-up means 18 where it is wound into a coreless roll 350. All of the means 314 to 320, 16 and 18, are located in the stated order along a film production line 324.

Film 312 can be extruded by any suitable method, such as film extrusion using air blowing techniques to inflate and collapse a bubble of molten material; chill roll casting, tubular bath extrusion, and the like. The invention will be described in relation to the bubble technique, but can be readily adapted to other extrusion methods.

The means generally comprises a plurality of extruders 326 connected by means of feeder tubes 328 to a die 330. The extruders 326 are connected to a source, possibly incorporated therein, of stock material, such as LLDPE, or the like. The construction and operation of extruders 326 is well known in the art. The number of extruders 326 depends upon the desired composition of film 312. For instance, if the film 312 is desired to have a tri-layered construction, then three extruders 312 would commonly be used. The extruders 326 heat the stock material to a molten condition, and deliver the molten stock material to die 330 through feeder tubes 328. Die 330 has means, well known to those skilled in the art, for producing a desired extruded configuration. In the case of blown films, die 330 is configured to produce a round, hollow tube of molten stock material. Die 330 is further provided with a stream of air, supplied by a well-known compressed air source 332 via a suitable feeder line 334. The compressed air enters the tube and inflates it into a substantially tubular bubble 336. Alternatively, the bubble 336 can be inflated and additionally cooled with internal bubble cooling (IBC) equipment, as is know to those of skill in the art.

Bubble 336 is continuously drawn away as more stock material is supplied to die 330 by extruders 326, thus moving bubble 336 along production line moving in the direction indicated by arrow 324 towards means 318. To regulate the shape of bubble 336, and to strenghten its outer periphery so that the compressed air will not form holes through the bubble 336, cooling means 316 are provided along the production line.

Cooling means 316 is commonly in the form of blowers 338, which direct controlled streams of air against the periphery of bubble 336. Preferably, the air comprising the streams is cooled or chilled by suitable means, such as an air conditioner or the like, and the streams are directed against the interior and exterior periphery of bubble 336. Cooling means 316 reduce the temperature of the molten stock material of bubble 336 substantially towards its freezing point, and approximately equal to the ambient temperature. The transformation from a molten to a frozen state occurs over a relatively short transition zone 90. At the end of the transition zone 90, the frozen bubble is moving along the production line at a lineal rate determined by a primary nip 348. In a preferred construction blowers 338 are provided at a plurality of locations along the production line.

Bubble 336 continues along the production line until it encounters a collapsing device 340. The collapsing device 340 is intended to collapse bubble 336 in to a sheet 342 of film material. Accordingly, sheet 342 is often two-ply having two sides joined at their common edges. Collapsing device 340 is well-known in the art, and is generally frusto-conical in shape. Collapsing device 340 has a large opening 344 opposed to die 330, and small opening 346 at its other end. Bubble 336 enters collapsing device 340 at large opening 344, and exits at small opening 346 as sheet 342.

Primary nip 348 which is formed from a plurality of driven rollers 350 engages sheet 342 as it exits collapsing device, as is well-known. The thickness of sheet 342, and thus the thickness of the resulting film, is determined by the extrusion rate, the diameter of bubble 336, and the speed at which sheet 342 is drawn through collapsing device by nip 348.

Sheet 342 then enters optional stretching means 318 for pre-stretching of the film. Stretching means 318 comprises the primary nip 348 and an intermediate nip 354 comprised of a pair of roller 356. Intermediate nip is rotated at a speed substantially greater that the speed of primary nip 348. Generally, intermediate nip 354 is run at approximately four times the speed of primary nip 348 thereby stretching sheet 342 by an amount proportional to the difference in speeds between the two sets of nips. If it is not desired to provide a pre-stretched film, intermediate nip 354 can be omitted and sheet 342 can pass directly to a series of idler rollers 364 and thence to tensioning means 16.

If sheet 342 has been pre-stretched, it then travels through relaxation means 320 comprised of a series of idler rollers 364 along the production line. Relaxing the sheet reduces the tension in the film and ensures that the film will have sufficient elasticity to conform to the external configuration of articles to be packages, and to withstand shocks, forces and tearing. The amount of relaxation in the film is determined by the amount of time, or distance travelled, by the film as it passes through the relaxation means 320. The distance travelled can be adjusted by lengthening the production line and providing additional idler rollers 364.

After the film 312 has relaxed, it passes through a trimmer 374 which cuts the film 312 along both outer edges to separate the film 312 into two films sheets 376 and 377 at tertiary nips 390. Each film sheet 376 and 377 then passes continuously through a tensioning means 16 and take-up means 18, as described above, to produce the desired coreless film rolls.

Figure 6:
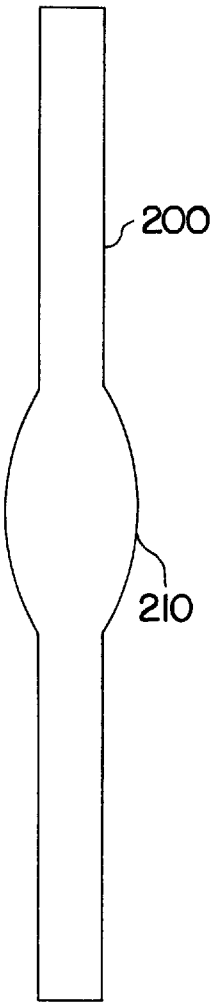
FIG. 6 shows a side view of a dispensing spindle in accordance with the present invention.

When it is desired to unroll, or dispense, plastic film from a coreless roll of the present invention by hand, a spindle 200, as illustrated in FIG. 6, can be employed. Spindle 200 is generally cylindrical with an enlarged, bulbous, centre portion 210. Spindle 200 can be inexpensively produced from polyvinyl chloride ("PVC"), or from other suitable rigid plastics, wood or metal. The spindle 200 has a length sufficient to allow both ends of the spindle 200 to extend beyond the edges of the roll. The centre portion 210 has a diameter sufficient to engage the interior surface of a coreless roll 50.

A person can then grasp the ends of the inserted spindle 200 and proceed to dispense film form the roll by allowing the spindle to rotate in the hands while, for example, wrapping a pallet load. The frictional engagement between the centre portion 210 and interior surface of the roll permits the roll to rotate with the spindle 200. Alternatively, spindle 200 can be mounted within known dispensers so that it can rotate freely, as is well known in the dispensing art, and the plastic film can be pulled from the roll.

As will be apparent to those of skill in the art, a coreless roll in accordance with the present invention can also be employed with machine dispensing systems or anywhere else that a cored roll would be employed, although a re-usable spindle may be required to be employed in some circumstances, such as where high speed dispensing is desired.

As will be apparent to those skilled in the art, the coreless roll of the present invention provides significant production, storage and shipping savings over prior art rolls which required expensive, heavy and unrecyclable cores. In particular, the weight and space taken up by a conventional core is eliminated, resulting in substantial savings to both the producer and consumer. Having no unrecyclable core to dispose is an added benefit and can result in substantial savings to a large consumer by reducing disposal costs.

It will also be apparent that the present invention is not limited to plastic film wrap, but can be used for any suitable material commonly rolled on a core, including PVC films, aluminum or other foils, etc.

It will be apparent to those skilled in the art that the foregoing is by way of example only. Modifications, variations and alterations may be made to the described embodiments without departing from the scope of the invention which is defined solely in the claims.

We claim:

1. An apparatus for producing a coreless roll from a self-adhesive material supplied as a continuous sheet, comprising:

a mandrel having a first configuration wherein a length of said sheet can be wound into a roll on a surface of the mandrel with a first perimeter and a second configuration wherein said surface has a perimeter less than said first perimeter to allow said mandrel to be removed from said roll;

a winder to rotate said mandrel to wind said length of sheet onto said mandrel in said first configuration; and a tensioner to longitudinally tension said length of sheet;

a controller to deactivate said tensioner while a preselected amount of said length is wound on to said mandrel under substantially no tension, and to activate said tensioner after said preselected amount has been wound to tension the remainder of said length, whereupon said mandrel can be reduced to said second configuration and removed from said roll.

2. An apparatus according to claim 1 wherein said preselected amount is determined by a measured length of said sheet of material.

3. An apparatus according to claim 1 wherein said preselected amount is determined by a measured thickness of said wound sheet of material.

4. An apparatus according to claim 1 wherein said preselected amount is determined when a timer, actuated at the commencement of winding said sheet of material, reaches a predefined time.

5. An apparatus according to claim 1 wherein said tensioner further operates to prestretch said sheet of material.

6. An apparatus according to claim 5 wherein said tensioner further operates to emboss a surface of said sheet of material.

7. An apparatus according to claim 1, wherein said mandrel includes a hollow outer shell with at least two apertures therethrough and an inner expandable member, said expandable member extending outwardly through said at least two apertures in said first configuration to form part of said first perimeter.

8. An apparatus according to claim 7 wherein expansion of said expandable member is accomplished by inflating said expandable member.

9. An apparatus according to claim 1, wherein said sheet of material is a plastic material chosen from the group consisting of polyethylene, polyvinyl chloride, ethylene vinyl acetate, ethylene methyl acetate, and linear low density polyethylene.

10. An apparatus according to claim 1, wherein said tensioner comprises a drive roller and a lay-on roller around which said sheet of material passes.

11. An apparatus according to claim 10 wherein said lay-on roller is in frictional contact with said mandrel.

12. A coreless roll formed from a continuous sheet of self-adhesive material, comprising:

a first portion of said continuous sheet of material wound to form an inner layer of said roll, said first portion being wound under substantially no tension on to an expansible mandrel, which mandrel is later collapsed and withdrawn from said roll;

a second portion of said continuous sheet of material wound to form an outer layer of said roll surrounding said inner layer, said outer layer being wound under a greater tension than said inner layer.

13. A coreless roll according to claim 12, wherein said material is a plastic material chosen from the group consisting of polyethylene, polyvinyl chloride, ethylene vinyl acetate, ethylene methyl acetate, and linear low density polyethylene.

14. A coreless roll according to claim 13 wherein said sheet of material is prestretched prior to winding.

* * * * *